US006336552B1

(12) United States Patent
Meier

(10) Patent No.: US 6,336,552 B1
(45) Date of Patent: Jan. 8, 2002

(54) ORGANIZER FOR AMMUNITION BOX

(75) Inventor: Peter John Meier, Cazenovia, NY (US)

(73) Assignee: RPM Industries, Inc., Auburn, NY (US)

( * ) Notice: Subject to any disclaimer, the term of this patent is extended or adjusted under 35 U.S.C. 154(b) by 0 days.

(21) Appl. No.: 09/658,640

(22) Filed: Sep. 11, 2000

(51) Int. Cl.[7] ..... F42B 39/00

(52) U.S. Cl. ..... 206/3; 206/499; 206/815; 220/833

(58) Field of Search ..... 220/553, 555, 220/528, 212.5, 23.91, 23.88, 833.835, 324; 206/3, 561, 499, 1.5, 508, 819, 372, 373

(56) References Cited

U.S. PATENT DOCUMENTS

| | | | | | |
|---|---|---|---|---|---|
| 671,817 | A | | 4/1901 | Daly | |
| 1,306,312 | A | | 6/1919 | Peoples | |
| 2,560,417 | A | | 7/1951 | Davis | |
| 2,566,016 | A | * | 8/1951 | Cochran | 206/815 |
| 2,566,569 | A | | 9/1951 | Jensen | |
| 2,769,565 | A | * | 11/1956 | Scottie | 206/835 |
| 2,868,360 | A | | 1/1959 | Donkin | |
| 3,146,935 | A | * | 9/1964 | Carkhuff et al. | 206/815 |
| 3,459,327 | A | | 8/1969 | Harris | |
| D227,517 | S | | 6/1973 | Minneman | |
| 3,856,178 | A | * | 12/1974 | Norgaard | 220/23.83 |
| 4,139,096 | A | | 2/1979 | Sieger | |
| D278,096 | S | | 3/1985 | Walker et al. | |
| 4,676,371 | A | * | 6/1987 | Byrne | 206/815 |
| 4,735,314 | A | * | 4/1988 | Kadleck et al. | 206/426 |
| 4,746,008 | A | * | 5/1988 | Heverly et al. | 206/1.5 |
| 4,782,977 | A | * | 11/1988 | Watanabe et al. | 220/835 |
| 4,892,220 | A | * | 1/1990 | Foos | 206/815 |
| 5,065,887 | A | * | 11/1991 | Schuh et al. | 206/205 |
| 5,417,339 | A | * | 5/1995 | Lin | 220/835 |
| 5,785,179 | A | * | 7/1998 | Buczwinski et al. | 206/494 |
| 6,186,351 | B1 | * | 2/2001 | Coyle | 220/512 |

* cited by examiner

*Primary Examiner*—Shian Luong
(74) *Attorney, Agent, or Firm*—Wall, Marjama & Bilinski

(57) ABSTRACT

A stackable insert for use in organizing the family members in a family of top opening military type ammunition boxes wherein each family member has the same base dimensions but a different height than other members in the family of boxes. The insert includes a rectangular shaped open top container and a flat lid that is hinged to one side wall of the container and secured at closure by a positive snap over latching mechanism. A pair of finger holes, or other lifting means, are provided in the lid which provides for easy lifting of the insert. A panel type separator divides the container into compartments. The insert is dimensioned so that a plurality of inserts can be stacked in each member sized ammunition box to maximize the usable space within each size box.

7 Claims, 2 Drawing Sheets

ORGANIZER FOR AMMUNITION BOX

FIELD OF THE INVENTION

This invention relates generally to an insertable organizer that is receivable within family of top opening military ammunition boxes wherein each box in the family has the same base dimensions of length and width and each member box within the family has a different height dimension than the other members of the family.

BACKGROUND OF THE INVENTION

New and used top opening military ammunition boxes have been favorites of collectors, sportsmen, mechanics and the like and used to store a wide variety of articles because the boxes are strongly built and easily portable, in many cases. Many times, articles stored in the boxes are relatively small in comparison to the interior volume of the boxes, and therefore, the stored contents become commingled and disorganized. Accordingly, retrieving a selected article from one of the boxes has oftentimes proven to be a rather time consuming and arduous task. Open top trays are available that can be stacked within ammunition boxes,. These trays are generally loosely stacked within the ammunition boxes and the articles contained in the trays can be easily spilled out of the trays in the event the ammunition box is tipped or roughly handled. The trays are also difficult to handle, particularly when being placed in or removed from an ammunition box.

SUMMARY OF THE INVENTION

It is therefore a primary object of the present invention to store diverse articles in a military ammunition box in an orderly manner.

It is a further object of the present invention to organize the interior of a top opening military ammunition box into compartments that are each readily accessible through the top opening.

A still further object of the present invention is to provide compartmentalized inserts that can be stacked one on top of the other within a family of ammunition boxes to maximize the usable space within the boxes of each family.

These and other objects of the present invention are attained by means of an organizer in the form of an insert that can be conveniently stacked in any one of the boxes in a family of top opening military style ammunition boxes wherein each member box within the family has the same interior length and width but has a different height from the other family members. The insert includes a rectangular shaped open top container having a length and width that enables the container to be slidably received within any family member box through the top opening of the box. The insert further contains a flat top cover that is hinged about one side wall of the container. A pair of spaced apart lugs are mounted at the top edge of the opposing container side wall and a flexible skirt which surrounds the cover arranged to close over the lugs. A pair of slotted cutouts are provided in the skirt so that the lugs snap into the cutouts when the cover is fully closed against the container. A pair of spaced apart finger holes are formed in the cover that allows for secure finger engagement of the insert when the cover is closed, without interfering with inner compartment separators.

Each container is of a uniform height that permits a plurality of inserts to be stacked one on top of the other through the top opening of each family member box to maximize the amount of interior space that is occupied by the stack.

BRIEF DESCRIPTION OF THE DRAWING

For a better understanding of these and objects of the present invention, reference will be made to the following detailed description of the invention which is to be read in connection with the accompanying drawing, wherein.

DETAILED DESCRIPTION OF THE INVENTION

Figure 1:
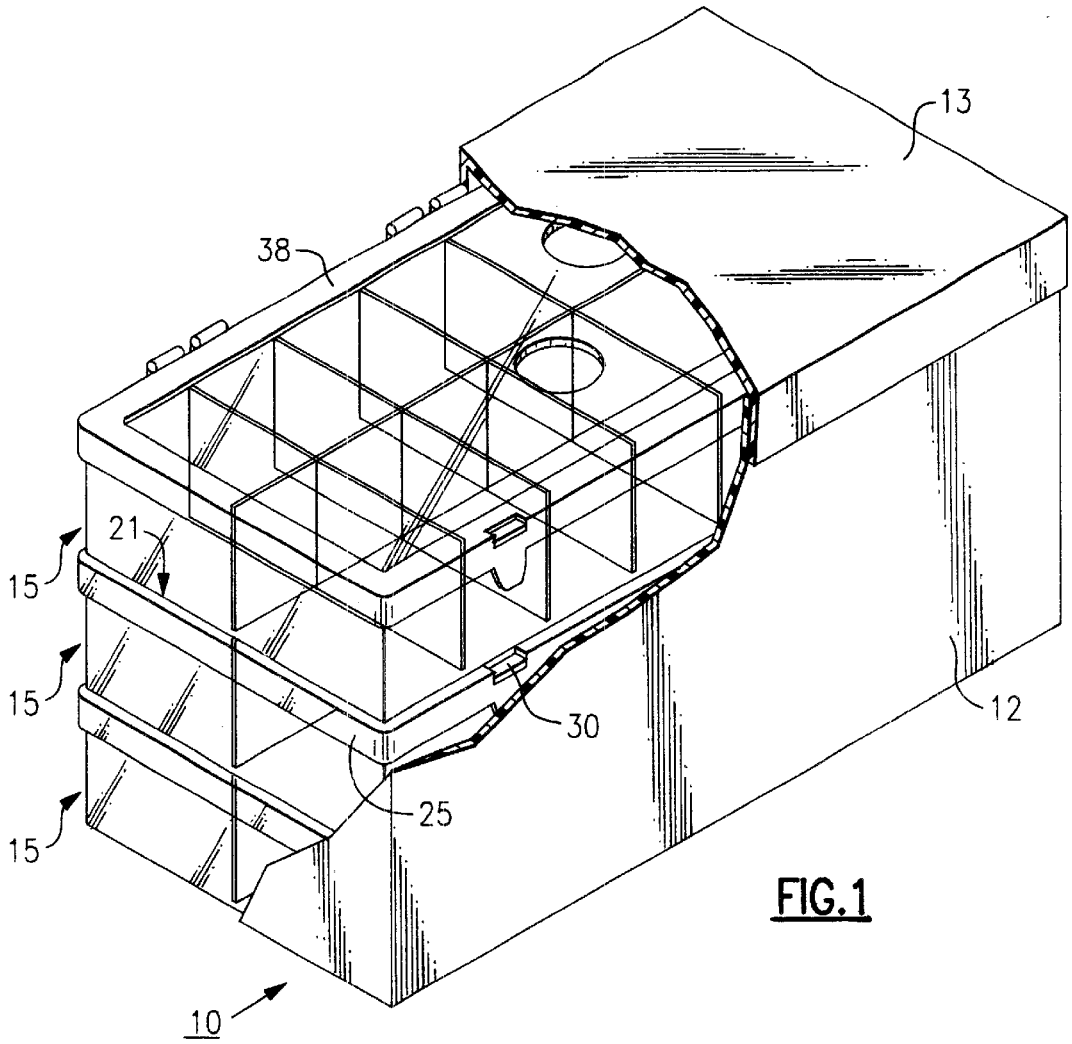
FIG. 1 is a perspective view of an ammunition box having portions broken away to show a series of inserts embodying the teachings of the present invention stacked therein.

Referring initially to FIG. 1, there is illustrated a military type ammunition box of well known construction that is generally referenced 10. The box includes a rectangular shaped lower open topped housing 12 and a top cover 13 that is hinged at one end wall of the housing so that the cover opens upwardly to provide a top entry into the housing. Typically, the military ammunition boxes are extremely rugged construction, being made of metal and are also relatively impervious to moisture. Accordingly, these boxes are ideally suited for storing a wide variety of articles. New and used ammunition boxes are sold by a number of outlet stores.

As noted above, military ammunition boxes come in various sizes depending upon the type of ammunition stored in the box. For a specific type of ammunition there is generally a family of boxes wherein each family member has a different capacity. Each box in the family, however, has the same base dimension of length and width with the difference between family members being in the height of the box.

As further illustrated, the ammunition box 10 contains a number of inserts 15—15 that are stacked one on top of the other inside the ammunition box. The inserts are sized so that they fit closely between the side walls and end walls of the box. The height of each insert is such that the inserts occupy most of the internal volume of the ammunition box.

Figure 2:
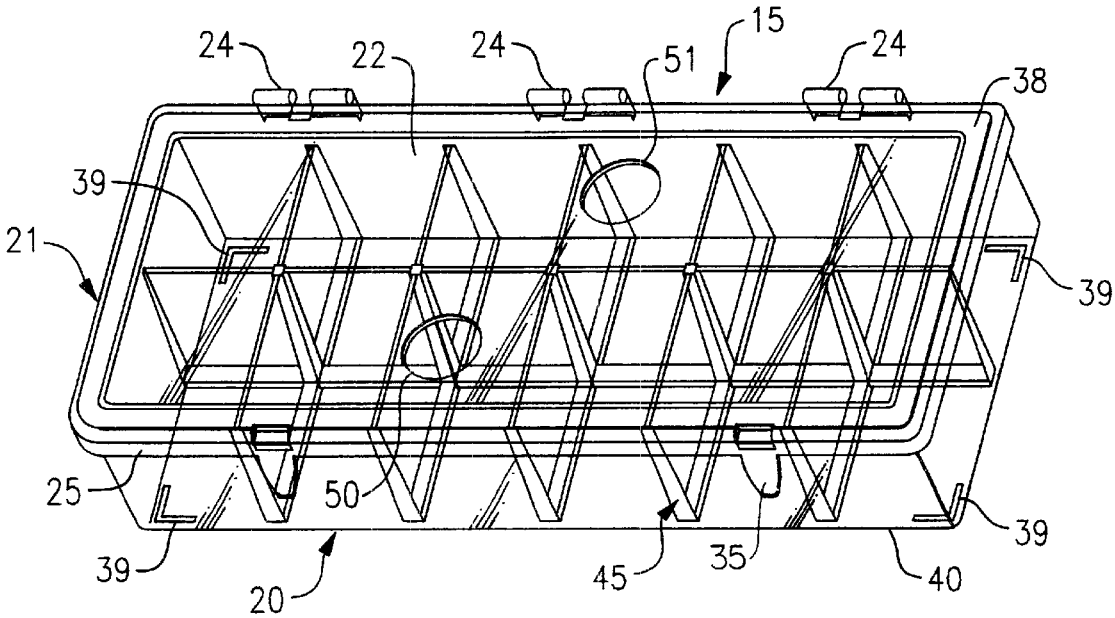
FIG. 2 is an enlarged top perspective view of an insert embodying the teachings of the present invention.

With further reference to FIGS. 2–5, each insert includes a rectangular container 20 and a flat lid 21 that is hinged to one side wall of the container by a plurality of hinges 24—24. Both the container and the lid are molded from high impact resistant plastic so that articles stored in the container can be easily viewed from any direction, however, they can be molded in opaque material without departing from the teachings of the present invention. The lid of the insert contains a downwardly depending skirt 25 formed of a flexible material that encircles the periphery of the lid and which surrounds the walls of the container when the lid is closed. This is best illustrated in FIGS. 1 and 2. The top surface 22 of the lid provides a flat platform at closure so that the bottom wall of one insert can be seated securely upon the lid of an underlying insert, when the inserts are stacked as shown in FIG. 1.

Figure 5:
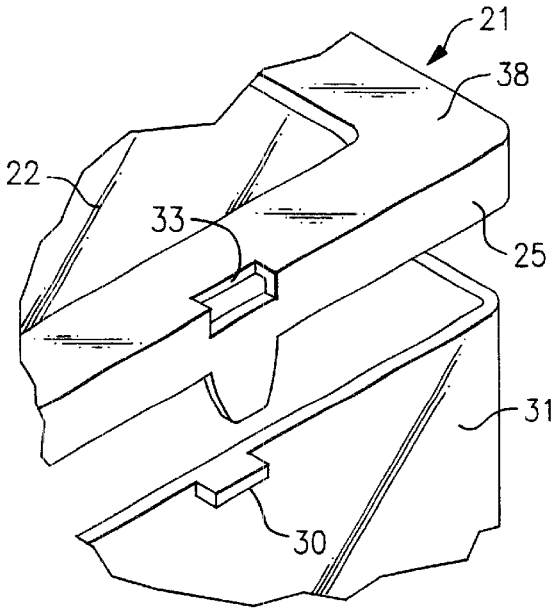
FIG. 5 is an enlarged partial perspective view showing the latch mechanism employed in the present invention.

A latch mechanism is provided for the lid which securely holds the lid in a tightly closed condition against the container when the lid is brought to a closed condition. As illustrated in FIG. 5, the latch mechanism includes a pair of lugs 30 that are mounted along the outer top edge of the second side wall 31 of the container. A slotted cutout 33 is provided along the top edge of the lid in registration with each of the lugs. A flexible tab 35 extends downwardly from the skirt of the lid directly beneath each slotted cutout. The tabs serve to initially contact the lugs as the cover is being closed and direct the lugs under the skirt of the lid which, in turn, directs the lugs into the companion cutout. The plastic lid has sufficient flexibility to deform slightly as the lugs ride under the skirt so that the skirt snaps over the lugs once the lugs enter the cutouts, thus securely closing the lid against the container. To release each latch, the tabs are turned outwardly from the lid sufficiently to release the lugs from the cutouts whereupon the lid can be easily raised, thus opening the container.

The lid 21 further contains a raised lid frame 38 that surrounds the top surface 22 of the lid so that the top surface of the lid is recessed within the frame. V-shaped pads 39 are mounted upon the bottom wall 40 of the container which extend downwardly to provide seats upon which the inserts rest. The pads are arranged to be received within the inside corners of the lid frame when the inserts are stacked as illustrated in FIG. 1, one upon the other. The pads fit snugly into the lid frame corners and hold the inserts in alignment when stacked as shown within an ammunition box.

Figure 3:
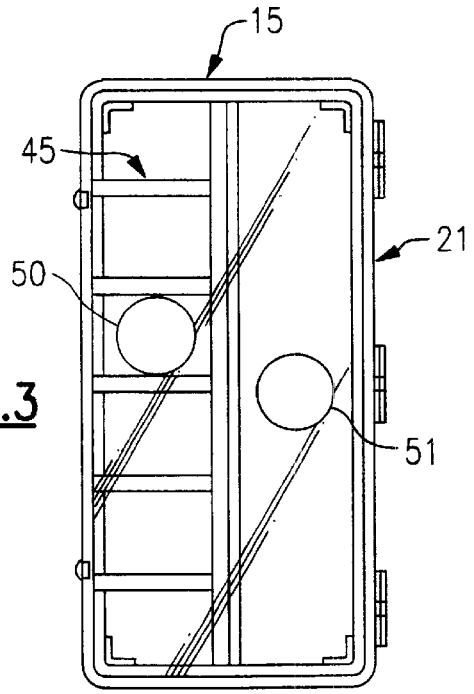
FIG. 3 is a top view of an insert embodying the present invention illustrating a first compartment arrangement within the insert.
Figure 4:
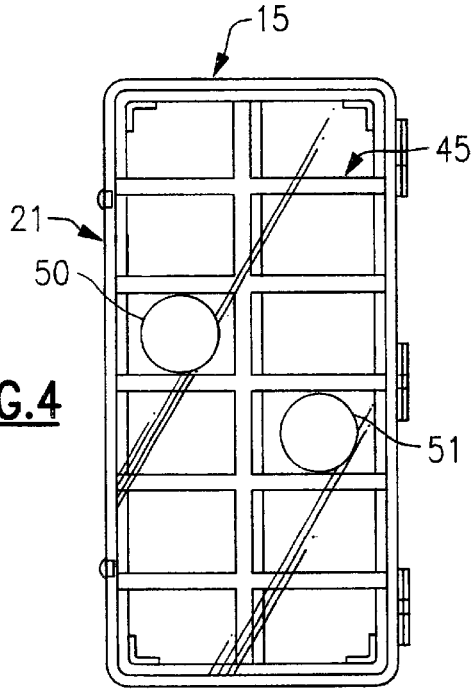
FIG. 4 is a view similar to that shown in FIG. 3 showing a second compartment arrangement within the insert.

A separator 45 is stored within the container that has panels that divide the interior of the container into a series of compartments. The separator can be integrally molded as part of the container or can be molded separately and removably housed within the container. The separators are furnished in various configurations to provide compartments of different sizes and shapes to accommodate a wide range of articles. Two such configurations are illustrated in FIGS. 3 and 4. It should be evident, however, that the separator may be configured to furnish any number of different sized compartments without departing from the teachings of the present invention.

The lid of each insert contains a pair of finger holes 50 and 51 that are longitudinally offset in the central part of the lid. The holes are arranged so that the thumb and the forefinger of a person's hand can pass through the holes into the insert and thus get a firm grip on the lid. The finger holes are arranged such that they do not interfere with the inner compartment separators, regardless of compartment configuration. Accordingly, each lid in a stack can be easily placed into and removed from an ammunition box. The snap over latch mechanism provides for secure closure of the lid such that the lid will not open when an insert is lifted using the finger holes. As noted above, the lid can only be opened by pulling the tabs outwardly away from the container a sufficient distance to free the lugs from beneath the lid skirt.

The chart depicted below illustrates a family of ammunition boxes, each of which has a base dimension of 11 1/32" in length and 5 9/16" in width. As set out in the first vertical column of the chart, there are five members in the family as identified by their military specification number. The second vertical column of each member in the family has a different vertical height with the height of each successive member increasing in about three inch increments. Using an insert having a length of about 11", a width of about 5½" and a height of about 2¼" the number of inserts shown in the third vertical column can be stored conveniently in each size member of the family.

| AMMO BOX SPEC. | MIL. BOX HEIGHT | NO. OF BOX INSERTS |
|---|---|---|
| M2A1 (50 CAL CAN) | 6-25/32" | 3 |
| XM515/PA19 | 9-25/32" | 4 |
| PA60 | 12-13/16" | 5 |
| PA70 | 15-13/16" | 7 |
| M721 | 18-5/16" | 8 |

As can be seen, using one insert that is dimensioned as noted above, almost the entire interior volume of each family member box can be compartmentalized both vertically and horizontally so that articles of varying sizes and shapes can be neatly organized and safely stored therein. Furthermore, each of the inserts can be easily and safely stacked and removed from any of the boxes using the finger holes.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for storing articles in an organized manner that includes a family of rectangular-shaped open top boxes each having the same inside base dimension of length and width and boxes in the family having a height that is some multiple of a given height dimension, a plurality of rectangular-shaped open top inserts stackable within each of the boxes, each insert further including four side walls, a flat bottom wall and a lid, hinge means for securing said lid to one side wall of said insert so that the lid can move between a first open position and a second closed position, said lid further including a raised frame surrounding the outer periphery of the lid, said frame having a flat top surface and a flexible skirt depending from said frame that encircles the side walls of the insert when the lid is in a closed position, a pair of spaced apart lugs, each lug extending outwardly from an upper edge of a second side wall opposite the first side wall so that the lugs pass in contact beneath said skirt to deform said skirt as the lid is moved into said closed position, a pair of spaced apart cutouts in said skirt that are aligned with said lugs so that said lugs snap into said cutouts when the lid is in a closed position, and at least two finger holes formed in said lid whereby each insert can be grasped to raise and lower the inserts into one of said boxes when said lid is in a closed position.

2. The apparatus of claim 1 wherein said boxes are ammunition boxes each having a top cover for closing said box.

3. The apparatus of claim 1 wherein each insert further includes pads mounted upon the bottom wall of said insert that are receivable within inside corners of said frame when the inserts are stacked one above the other inside said boxes.

4. The apparatus of claim 1 that further includes separators removably mounted inside each insert, said separators containing panels for dividing the inside of said insert into a series of compartments.

5. The apparatus of claim 4 wherein each insert is fabricated of a clear plastic material.

6. The apparatus of claim 5 wherein said finger holes in said lid are located over one of said compartments.

7. The apparatus of claim 1 that further includes a tab that depends from said skirt below each cutout whereby the skirt can be deformed beneath each cutout to free the lugs from the cutouts.

* * * * *